US012064001B2

(12) United States Patent
Noordzij

(10) Patent No.: US 12,064,001 B2
(45) Date of Patent: Aug. 20, 2024

(54) HELMET MOUNTED VISOR ASSEMBLY

(71) Applicant: GENTEX CORPORATION, Simpson, PA (US)

(72) Inventor: Duco Noordzij, Roslindale, MA (US)

(73) Assignee: GENTEX CORPORATION, Simpson, PA (US)

( * ) Notice: Subject to any disclaimer, the term of this patent is extended or adjusted under 35 U.S.C. 154(b) by 0 days.

(21) Appl. No.: 18/546,175

(22) PCT Filed: Feb. 18, 2022

(86) PCT No.: PCT/US2022/016923
§ 371 (c)(1),
(2) Date: Aug. 11, 2023

(87) PCT Pub. No.: WO2022/178213
PCT Pub. Date: Aug. 25, 2022

(65) Prior Publication Data

US 2024/0081464 A1 Mar. 14, 2024

Related U.S. Application Data

(60) Provisional application No. 63/152,039, filed on Feb. 22, 2021.

(51) Int. Cl.
*A42B 3/22* (2006.01)

(52) U.S. Cl.
CPC ..... *A42B 3/222* (2013.01); *A42B 3/228* (2013.01)

(58) Field of Classification Search
CPC ..... A42B 3/222; A42B 3/228; F41H 1/04; F41H 1/06; F41H 1/08
See application file for complete search history.

(56) References Cited

U.S. PATENT DOCUMENTS

| | | | | |
|---|---|---|---|---|
| 4,170,042 | A | 9/1979 | Aileo | |
| 4,807,305 | A | 2/1989 | Sundahl | |
| 2011/0067158 | A1 | 3/2011 | Lee | |
| 2015/0245682 | A1* | 9/2015 | McGinn ..... | A42B 3/205 2/424 |

OTHER PUBLICATIONS

Search Report and Written Opinion for International Patent Application No. PCT/US2022/016923, dated May 18, 2022, 8 pages.

* cited by examiner

*Primary Examiner* — Khoa D Huynh
*Assistant Examiner* — Erick I Lopez
(74) *Attorney, Agent, or Firm* — Morgan, Lewis & Bockius LLP

(57) ABSTRACT

A visor assembly for a helmet includes a helmet cover configured to couple to a helmet, a visor pivotably coupled to the helmet cover and configured to selectively pivot between a stowage position and one or more usage positions relative to the helmet cover, and a latching mechanism coupled to the visor. The latching mechanism includes a first pawl configured to rotate between a locked position and an unlocked position. The latching mechanism is further configured to releasably lock the visor in one or more of the stowage position and the one or more usage positions.

18 Claims, 16 Drawing Sheets

HELMET MOUNTED VISOR ASSEMBLY

CROSS-REFERENCE TO RELATED APPLICATIONS

This application is a 371 National Stage Entry of International Patent Application No. PCT/US2022/016923 filed Feb. 18, 2022, which claims the benefit of U.S. Provisional Patent Application No. 63/152,039 filed Feb. 22, 2021 entitled "Helmet Mounted Visor Assembly", each of which is incorporated by reference herein in its entirety.

FIELD OF THE INVENTION

The present invention generally relates to a visor for use with a helmet and, more particularly, to a helmet mounted visor assembly for coupling eye protection to a helmet.

BACKGROUND

Eye protection for protecting a user's face and/or eyes are used in different environments and for many different purposes. Depending on the use and/or environment in which eye protection is desired, it may be desired to couple the eye protection to a helmet worn by a user. For example, eye protection may be attached to helmets for use in operation of vehicles, such as aircraft, or during military engagement.

During use, eye protection, such as a visor coupled to a helmet, may be positioned relative a user's face in a position desired by the user. In some instances, external forces may act on the eye protection and helmet causing the eye protection to move away from the position desired by the user. For example, during operation of an aircraft, the user may experience high accelerations forces, or high G forces, which may cause the eye protection to move away from the desired position. In some situations, vibrations experienced during use may also cause the eye protection to be moved away from the desired position. In some instances, high wind speeds experienced during ejection from an aircraft may cause the eye protection to be moved away from the desired position.

In use, it may also be desired that the eye protection fit tightly around or close to one or more other accessories used by the user. For example, the eye protection may be positioned above an oxygen mask used during operation of an aerial vehicle. Placement of the oxygen mask relative to the helmet may be different for different users. For example, the placement of the oxygen mask is dependent on the shape and size of a user's face. Therefore, there is a need to provide a helmet mounted visor assembly configured to couple eye protection to a helmet in a plurality of positions relative the users face to allow for variations in mask placement while keeping the position of the eye protection secured during use.

BRIEF SUMMARY OF THE DISCLOSURE

In one embodiment there is a visor assembly for a helmet including a helmet cover configured to couple to a helmet, a visor pivotably coupled to the helmet cover and configured to selectively pivot between a stowage position and one or more usage positions relative to the helmet cover, and a latching mechanism coupled to the visor. The latching mechanism includes a first pawl configured to rotate between a locked position and an unlocked position, the latching mechanism further configured to releasably lock the visor in one or more of the stowage position and the one or more usage positions.

In some embodiments, the helmet cover includes a shroud mount configured to couple one or more accessories to the helmet cover. In some embodiments, the shroud mount includes one or more ratchets configured to engage the latching mechanism when the visor is in a usage position of the one or more usage positions. In some embodiments, the shroud mount includes one or more flanges, the one or more ratchets disposed between the one or more flanges and the helmet cover. In some embodiments, the shroud mount includes one or more stops positioned proximate the one or more ratchets, the one or more stops configured to prevent rotation of the visor in at least one direction.

In some embodiments, the helmet cover includes a pair of locking engagements configured to releasably lock the visor in the stowage position. In some embodiments, the latching mechanism includes a second pawl disposed opposite the first pawl, the second pawl configured to rotate between the locked position and the unlocked position. In some embodiments, the latching mechanism is fixedly coupled to a top surface of the visor. In some embodiments, the latching mechanism includes a first biasing element biasing the first pawl towards the locked position.

In another embodiment there is a helmet system including a helmet having an outer surface and an inner surface, a helmet cover coupled to the outer surface of the helmet, a visor pivotably coupled to the helmet cover and configured to selectively pivot from a stowage position to one or more usage positions relative to the helmet cover, and a latching mechanism coupled to the visor. The latching mechanism includes a first pawl configured to rotate between a locked position and an unlocked position, the latching mechanism is further configured to releasably lock the visor in one or more of the stowage position and the one or more usage positions.

In some embodiments, the helmet cover includes a shroud mount configured to couple one or more accessories to the helmet cover. In some embodiments, the shroud mount includes one or more ratchets configured to engage the latching mechanism when the visor is in a usage position of the one or more usage positions. In some embodiments, the shroud mount includes one or more flanges, the one or more ratchets disposed between the flanges and helmet cover. In some embodiments, the shroud mount includes one or more stops positioned proximate the one or more ratchets, the one or more stops configured to prevent rotation of the visor in at least one direction. In some embodiments, the helmet cover includes a pair of locking engagements configured to releasably lock the visor in the stowage position. In some embodiments, the latching mechanism includes a second pawl disposed opposite the first pawl, the second pawl configured to rotate between the locked position and the unlocked position. In some embodiments, the latching mechanism is fixedly coupled to the visor. In some embodiments, the latching mechanism includes a first biasing element biasing the first pawl towards the locked position.

In another embodiment there is a visor assembly including a helmet cover configured to couple to an outer surface of a helmet, and a visor having a top surface and a bottom surface, the visor coupled to the helmet cover and configured to pivot between a stowage position and one or more usage positions relative to the helmet cover. The visor assembly further includes a latching mechanism coupled to the top surface of the visor. The latching mechanism includes a first pawl configured to rotate between a locked position and an unlocked position, a second pawl disposed opposite the first pawl, the second pawl configured to rotate between the locked position and the unlocked position. The latching mechanism is further configured to releasably lock the visor in one or more of the stowage position and the one or more usage positions. The visor assembly further includes a shroud mount coupled to the helmet cover, the shroud mount including one or more ratchets configured to engage the latching mechanism when the visor is in a usage position of the one or more usage positions, and a pair of locking engagements coupled to the helmet cover and configured to releasably lock the visor in the stowage position. In some embodiments, the shroud mount includes one or more stops positioned proximate the one or more ratchets, the one or more stops configured to prevent rotation of the visor in at least one direction.

BRIEF DESCRIPTION OF THE DRAWINGS

The following detailed description of embodiments of the helmet mounted visor assembly, will be better understood when read in conjunction with the appended drawings of an exemplary embodiment. It should be understood, however, that the invention is not limited to the precise arrangements and instrumentalities shown.

In the drawings.

DETAILED DESCRIPTION

Figure 1:
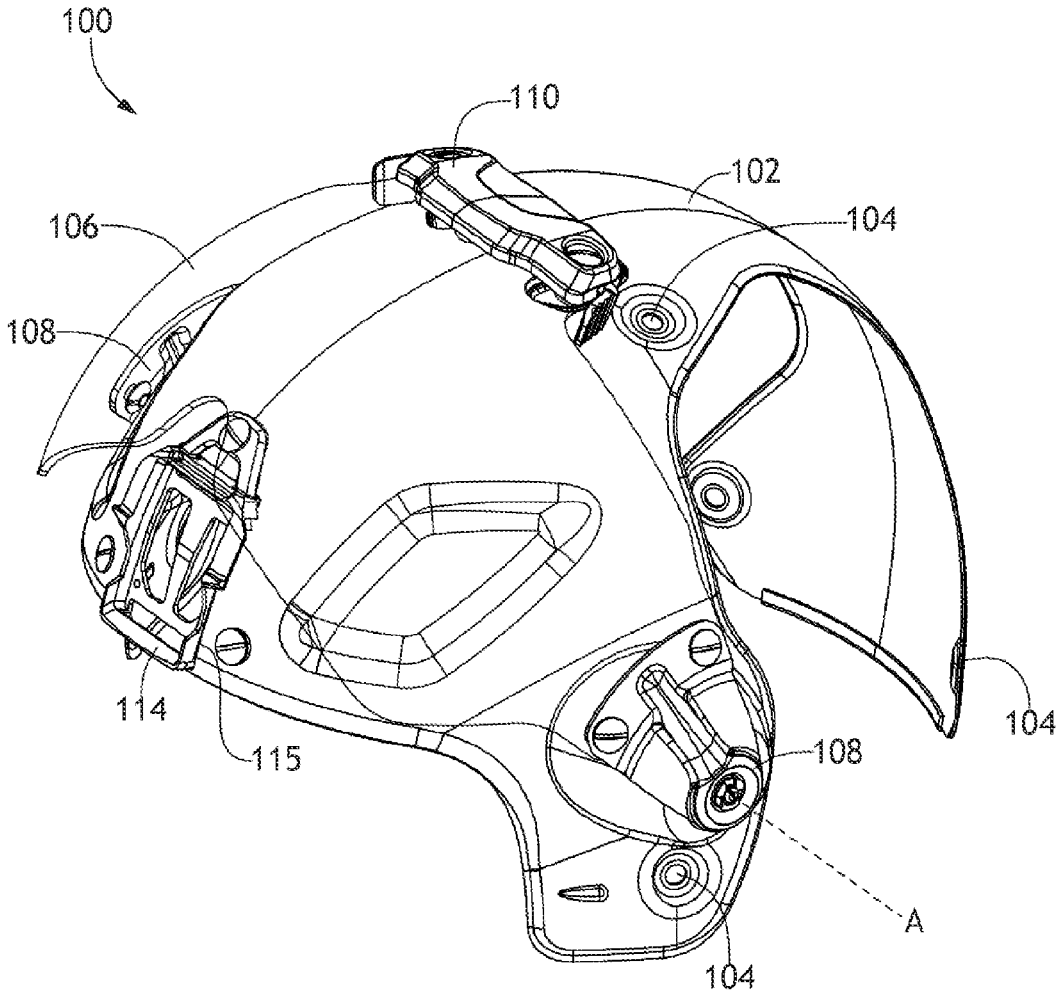
FIG. 1 is a perspective view of a helmet mounted visor assembly in accordance with an exemplary embodiment of the present invention.

Referring to the drawings in detail, wherein like reference numerals indicate like elements throughout, there is shown in FIGS. 1-16 a helmet mounted visor assembly, generally designated 100, in accordance with an exemplary embodiment of the present invention.

Figure 2:
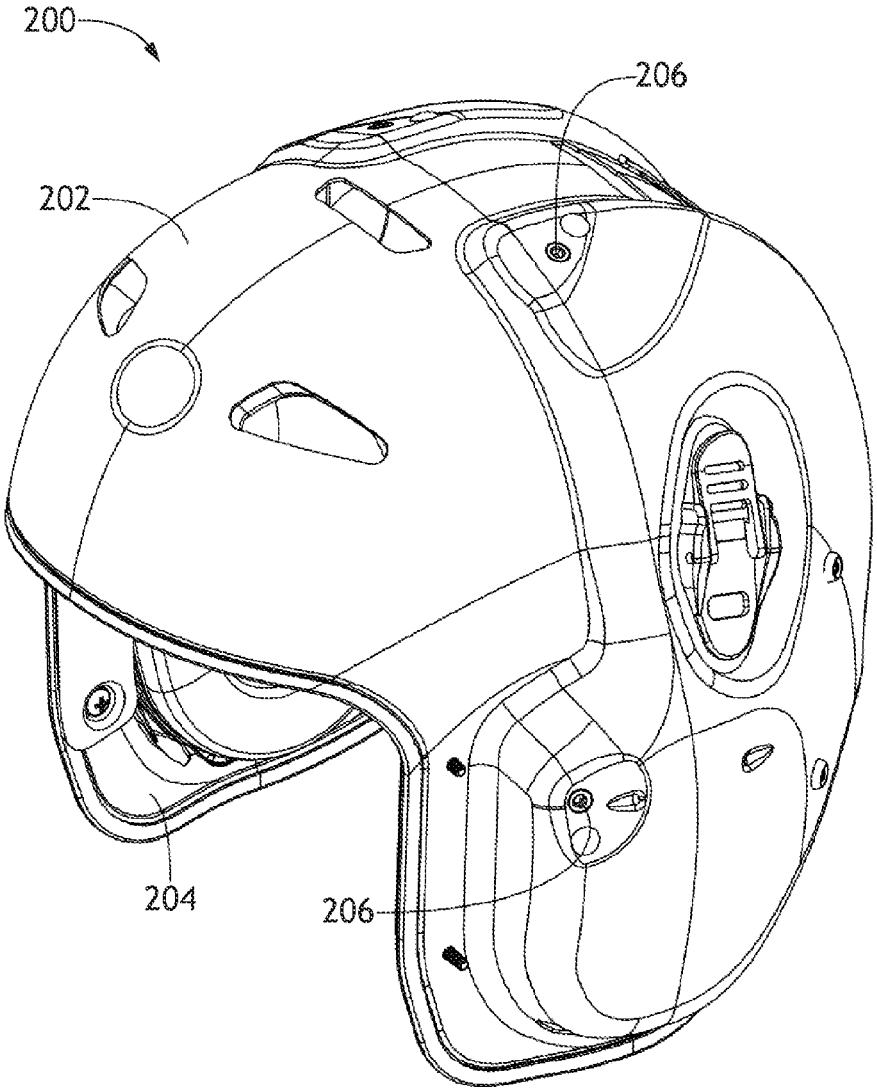
FIG. 2 is a perspective view of a helmet for use with the helmet mounted visor assembly of FIG. 1.

Referring to FIG. 1, there may be a helmet mounted visor assembly 100 configured to couple to a helmet (e.g., helmet 200 in FIG. 2). The helmet mounted visor assembly 100 may include a helmet cover 102 for coupling to a portion of a helmet. The helmet cover 102 may be configured to couple to an outer surface of a helmet. The helmet cover 102 may be sized and shaped such that it matches the contour of the outer surface of a helmet. For example, the inner surface of the helmet cover 102 may match the contour of a portion of the outer surface of the helmet upon which the helmet cover 102 is configured to couple to. The helmet cover 102 may include a plurality of mounting locations 104 for receiving fasteners to couple the helmet cover 102 to the outer surface of a helmet. In some embodiments, the mounting locations 104 may be sized to receive fasteners such as, but not limited to, bolts, screws, or any other fastening means. In this manner the helmet cover 102 may be configured to detachably couple to a helmet. In some embodiments, the helmet mounted visor assembly 100 may alternatively be referred to as a helmet visor module. In some embodiments, the helmet cover 102 may alternatively be referred to as a helmet cap, visor attachment, or helmet module.

The helmet mounted visor assembly 100 may include a visor 106 for providing eye protection to a user. The visor 106 may be configured to pivot relative to the helmet cover 102. For example, the visor 106 may be pivotably coupled to the helmet cover 102. The visor 106 may include mounting arms 108 disposed on opposite ends of the visor 106 that are each configured to pivotably couple the visor 106 to helmet cover 102. The visor 106 may pivot about axis A between a stowage position (FIG. 1) and one or more usage positions as described in more detail below. In some embodiments, visor 106 is configured to remain in the stowage position and/or the one or more usage positions during high wind stream situations, such as during operation of a helicopter, cargo plane, or military aircraft. For example, visor 106 may remain in the stowage position and/or the one or more usage positions when bumped (e.g., exposed to an external impact or force) or during winds in excess of 160 knots. In one embodiment, visor 106 is comprised of a resilient material. For example, visor 106 may be made of a polycarbonate material or polyester alternatives. However, visor 106 may be comprised of other materials such as metal, steel, polymers, or any other material desired. In one embodiment, visor 106 is comprised of a lightweight material that is also resilient. Visor 106 may include the use of laser protective dyes and coatings, light reducing and reflecting dyes and coatings, and integration with anti-scratch, anti-fog, anti-reflection, and/or anti-smudge coatings.

Mounting arms 108 may be coupled to visor 106 by one or more fasteners (e.g., screws, bolts). The mounting arms 108 may be disposed on opposite ends of visor 106. The visor 106 may have a length extending along the visor 106 from one mounting arm 108 to the mounting arm 108 on the opposite side. In one embodiment, the visor 106 is optically opaque to lasers and/or lights. However, visor 106 may have any level of transparency. For example, visor 106 may be fully transparent, semi-transparent, or may be optically opaque. In some embodiments, the transparency of visor 106 is altered by varying the base material of visor 106 and/or by adding color/laser absorptive dies. In some embodiments, the addition of additional dies may not increase the thickness of visor 106. Further, absorptive and reflective coatings may be used on visor 106 to alter the transparency of visor 106.

The visor 106 may include a latching mechanism 110 for locking the visor 106 in the stowage position or any one of the one or more usage positions. The latching mechanism 110 may be configured to interface with an accessory mount (e.g., shroud mount 114) included in the helmet mounted visor assembly 100. For example, the shroud mount 114 may be configured to engage with latching mechanism 110 to releasably lock the visor 106 in one or more usage positions, as discussed in more detail below. The shroud mount 114 may be disposed on a front portion of the helmet cover 102. For example, the shroud mount 114 is positioned on the front portion of the helmet cover 102 and is generally centrally located between the left and right sides of the helmet cover 102. In some embodiments, the shroud mount 114 extends at least partially outward and away from the outer surface of the helmet cover 102. In some embodiments, a bottom peripheral edge of the shroud mount 114 is proximate a bottom peripheral edge of the helmet cover 102. In some embodiments, the helmet cover 102 may define an aperture 115 configured to receive the shroud mount 114. The shroud mount 114 may extend at least partially through the aperture 115 to couple to the helmet cover 102. In some embodiments, an inner surface of the shroud mount 114 is positioned interior to the inner surface of the helmet cover 102 and an outer surface of the shroud mount 114 is positioned exterior to the outer surface of the helmet cover 102. In some embodiments, the inner surface of the shroud mount 114 may be generally flush with the outer surface of the helmet cover 102. In some embodiments, the inner surface of the shroud mount 114 may be at least partially recessed within the helmet cover 102 such that it is positioned between the inner and outer surfaces of the helmet cover 102.

In some embodiments, the shroud mount 114 is configured to couple one or more accessories to the helmet mounted visor assembly 100 and/or the helmet 200. For example, the shroud mount 114 may be configured to couple an optical device (e.g., night vision goggles, binoculars) to helmet cover 102. For example, the shroud mount 114 may include a recessed receiving area 122 configured to receive an accessory. In some embodiments, the accessory may be releasably coupled to the helmet cover 102 via the receiving area 122 of the shroud mount 114. In some embodiments, the shroud mount 114 is configured to receive an accessory while the visor 106 is in a usage position.

Figure 11:
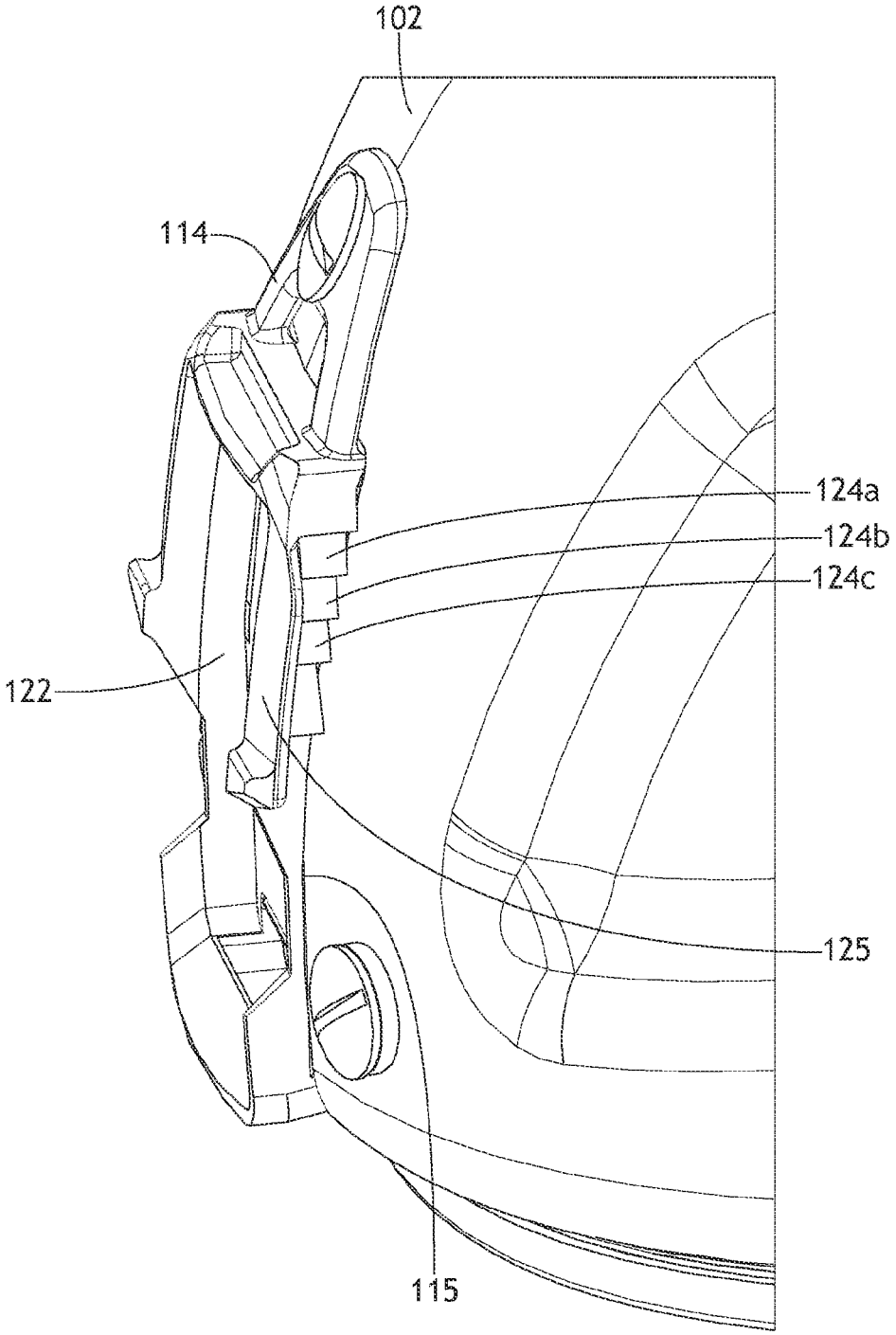
FIG. 11 is a zoomed in view of the shroud mount having a second pair of locking engagements of the helmet mounted visor assembly of FIG. 1.

Referring to FIG. 11, shroud mount 114 may include one or more ratchets 124*a*-124*c* configured to engage latching mechanism 110. Each of the one or more ratchets 124*a*-124*c* may be a pair of ratchets disposed on opposite sides of shroud mount 114. For example, the view shown in FIG. 11 is a left side view of the shroud mount 114 showing ratchets 124*a*-124*c*. Each of ratchets 124*a*-124*c* has a corresponding ratchet on the right side of the shroud mount 114 for engaging the latching mechanism 110. In a preferred embodiment, shroud mount 114 includes three pairs of ratchets disposed along a portion of a length of the shroud mount 114. In other embodiments, shroud mount 114 includes two ratchets, four ratchets, five ratchets, six ratchets, or 7 or more ratchets disposed along the length of shroud mount 114. By providing one or more ratchets 124*a*-124*c*, the visor 106 may be adjustable such that the visor 106 can be locked into one or more corresponding usage positions.

Shroud mount 114 may include one or more flanges 125 disposed above ratchets 124*a*-124*c*. Put another way, the flanges 125 may be disposed on an outer surface of the shroud mount 114 opposite an inner surface of the shroud mount 114 and the ratchets 124*a*-124*c* may be positioned between the outer surface and inner surface of the shroud mount 114. In some embodiments, the ratchets 124*a*-124*c* are positioned between the flanges 125 and the outer surface of the helmet cover 102 when the shroud mount 114 is coupled to the helmet cover 102. The one or more flanges 125 may be configured to retain engagement of the latching mechanism 110 with the shroud mount 114 during vibration or in high winds. For example, the flanges 125 may prevent the latching mechanism 110 from disengaging with one of the ratchets 124*a*-124*c* by providing a surface exterior to the exterior surface of the helmet cover 102. Shroud mount 114 may include a flange 125 on the right side (shown) and left side (not shown) disposed above corresponding ratchets 124*a*-124*c*. Flange 125 may form a slot between the flange 125 and helmet cover 102 in which the ratchets 124*a*-124*c* are disposed. The flange 125 may constrain movement of latching mechanism 110 such that the latching mechanism 110 may be prevented from disengaging with ratchets 124*a*-124*c* during vibration or high winds. For example, the flange 125 may prevent latching mechanism 110, when engaged with a corresponding ratchet 124*a*-124*c*, from moving in a direction other than the direction defined by ratchets 124*a*-124*c* (e.g., a direction away from the outer surface of the helmet cover 102). It will be understood that the flanges 125 and/or ratchets 124*a*-124*c* may be sized such that the latching mechanism 110 is able to move toward or away from the outer surface of the helmet cover 102 while still preventing the latching mechanism from disengaging the ratchets 124*a*-124*c* due to movement away from the outer surface of the helmet cover 102. Engagement of the latching mechanism 110 and ratchets 124*a*-124*c* is discussed in greater detail below with reference to FIG. 12.

Figure 3:
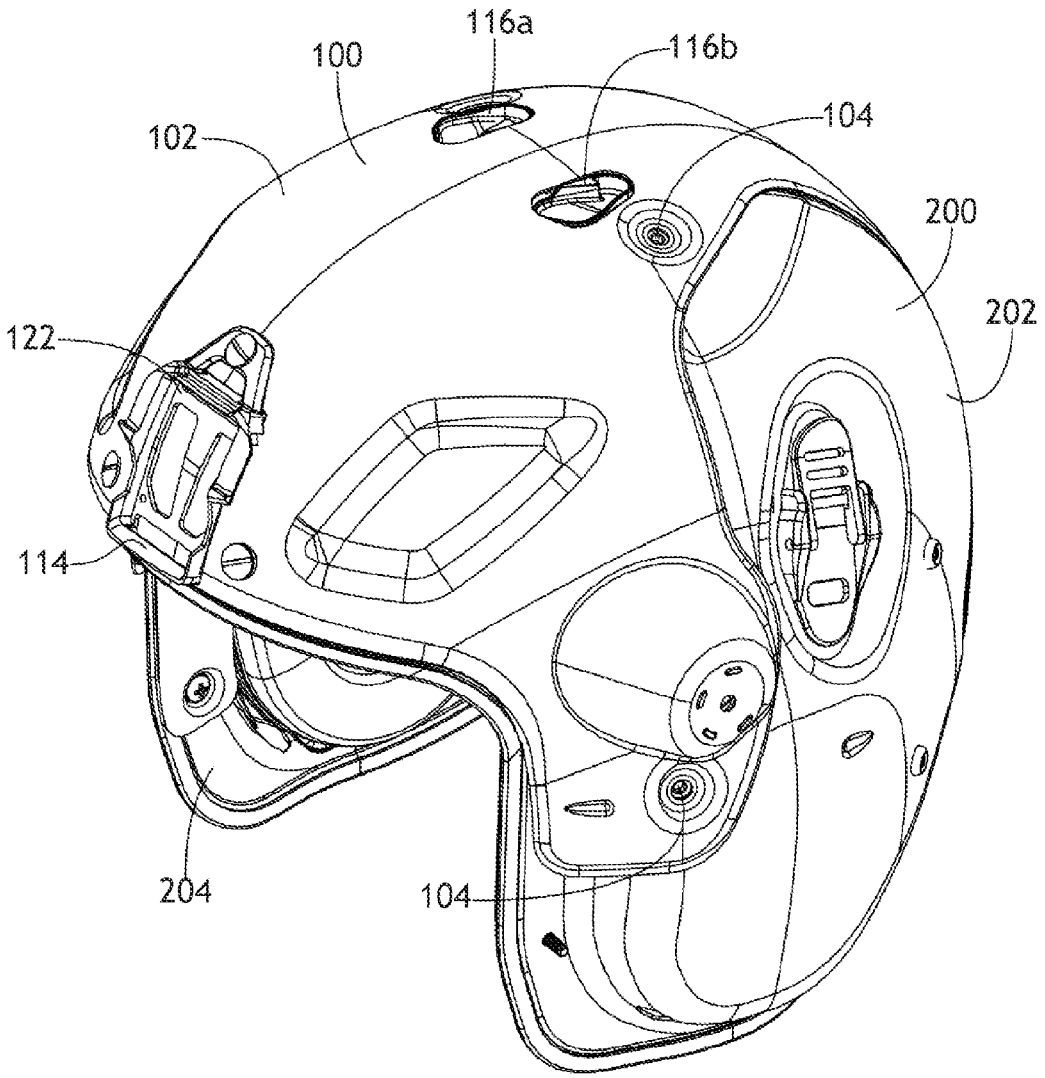
FIG. 3 is a perspective view of the helmet of FIG. 2 with the helmet mounted visor assembly of FIG. 1 attached thereto.
Figure 4:
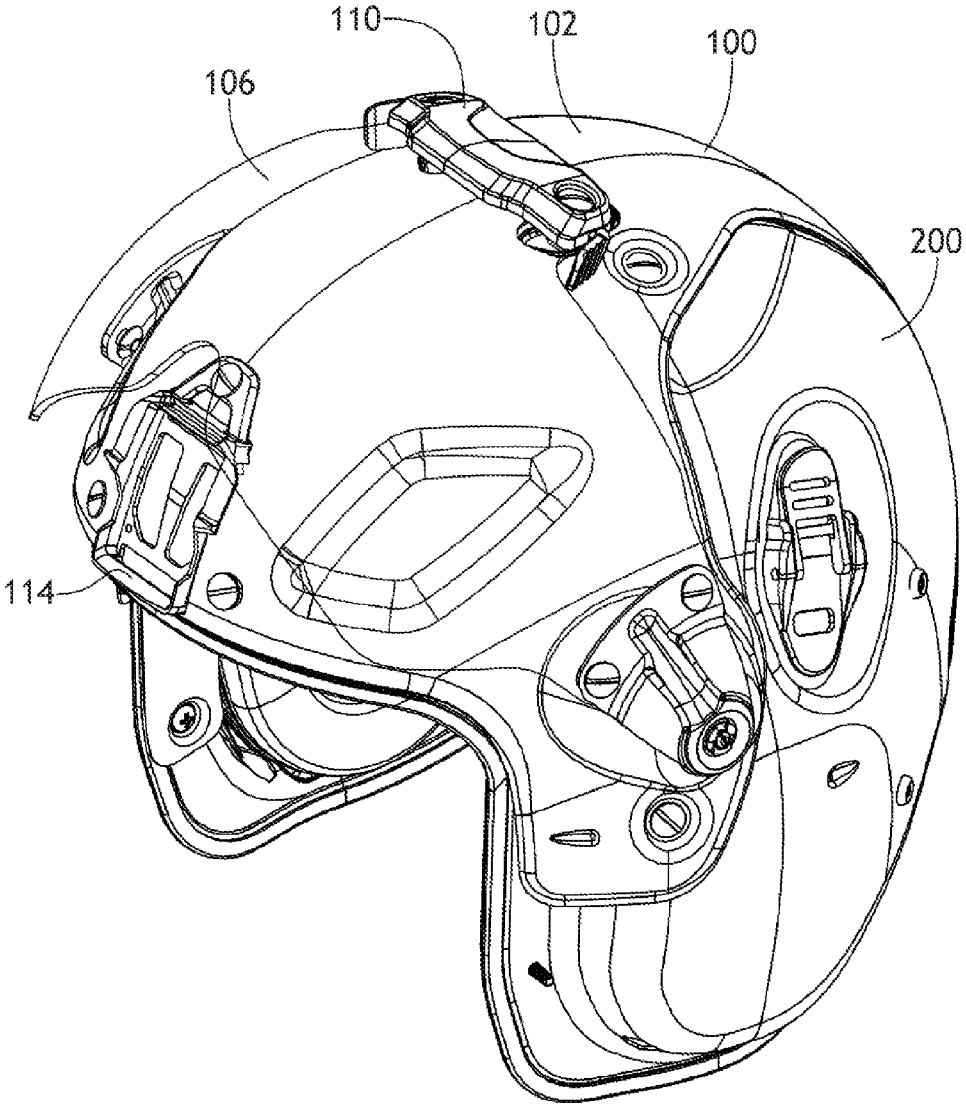
FIG. 4 is a perspective view of the helmet and helmet mounted visor assembly of FIG. 3 shown in a stowage position.

Referring to FIGS. 2-4, the helmet mounted visor assembly 100 may be configured to couple to a helmet 200. Helmet 200 may have an outer surface 202 and an inner surface 204. Helmet 200 may be configured to receive the helmet mounted visor assembly 100. Helmet 200 may include a plurality of receiving areas 206 for coupling the helmet mounted visor assembly 100 to helmet 200. The plurality of receiving areas 206 may be positioned along the outer surface 202 of helmet 200 such that when the helmet cover 102 is placed on helmet 200, the plurality of mounting locations 104 of helmet cover 102 overlap the plurality of receiving areas 206. In some embodiments, fasteners (not shown) extend through each mounting location 104 and into a corresponding receiving area to couple the helmet cover 102 to helmet 200. In some embodiments, helmet 200 is an advanced combat helmet (ACH), an enhanced combat helmet (ECH), a modular integrated communications helmet (MICH), a tactical ballistic helmet (TBH), a lightweight marine helmet, police general duty helmet, a personnel armor system for ground troops (PASGT), or an aircrew helmet, such as an HGU-56/P rotary wing helmet, an HGU 55/P fixed wing helmet, or any other aircrew helmet. The helmet cover 102 may be configured to cover a portion of helmet 200 The helmet cover 102 may extend over a top surface of helmet 200. The helmet cover 102 may extend across an area of the helmet 200 corresponding to a user's forehead. The helmet cover 102 may extend from a front portion of the helmet 200 to a rear portion of the helmet.

Figure 8:
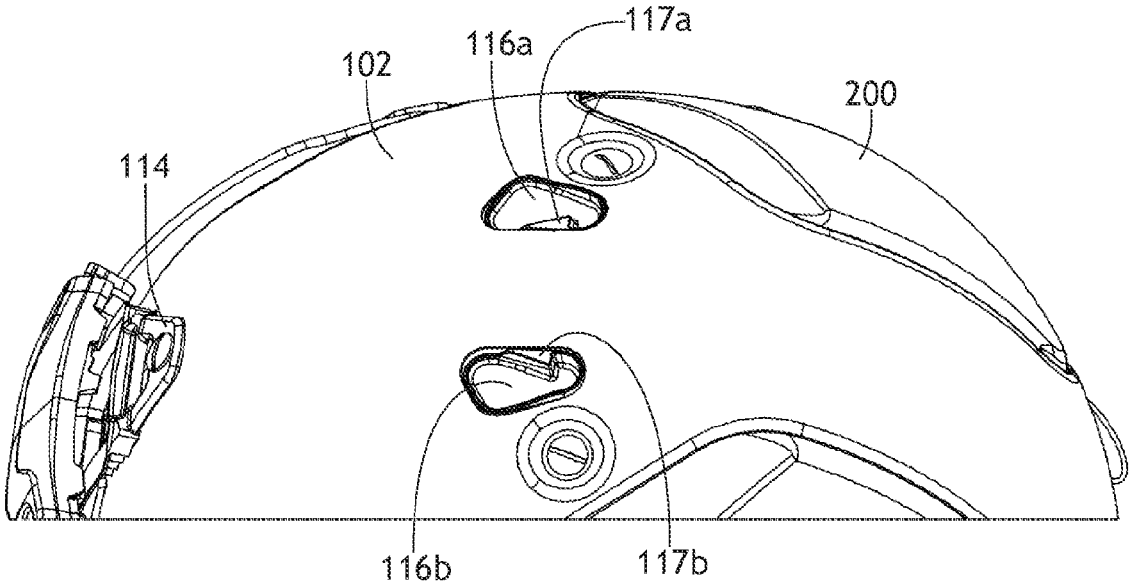
FIG. 8 is a zoomed in view of a first pair of locking engagements of the helmet cover of FIG. 1.

Referring to FIGS. 3 and 8, helmet cover 102 may include locking engagements 116 for locking the visor 106 in a stowage position. The locking engagements 116 may include a right locking engagement 116*a* and a left locking engagement 116*b*. Locking engagements 116*a*, 116*b* may be disposed on a top surface of helmet cover 102. In some embodiments, the locking engagements 116*a*, 116*b* are recessed relative to the outer surface of the helmet cover 102. Locking engagements 116*a* and 116*b* may be configured to receive the latching mechanism 110 of visor 106 to retain visor 106 in a stowage position (FIG. 4). Each locking engagement 116*a*, 116*b* may include a corresponding ratchet 117*a*, 117*b* for engaging the latching mechanism 110. In some embodiments, the locking engagements 116*a*-116*b* are integrally formed with the helmet cover 102. In other embodiments, the locking engagements 116*a*-116*b* are detachably coupled to the helmet cover 102.

Figure 5:
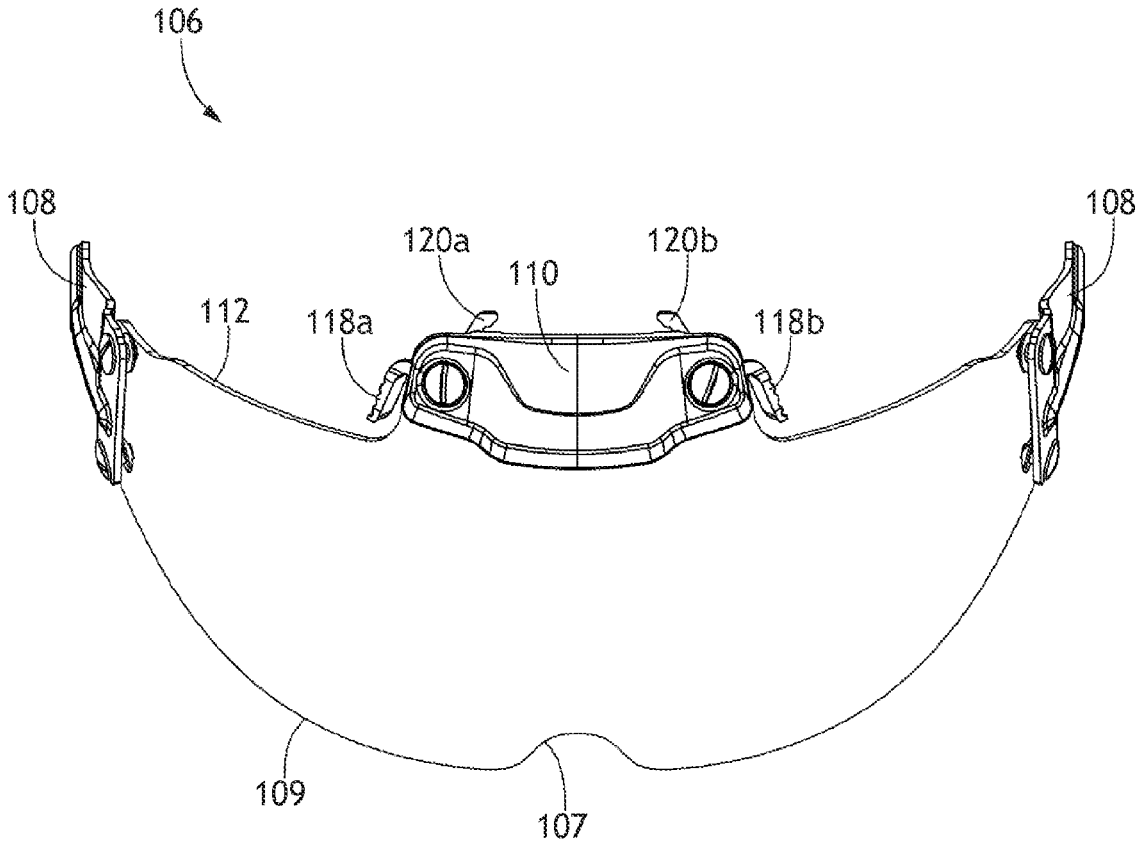
FIG. 5 is a front view of the visor of FIG. 1.
Figure 6:
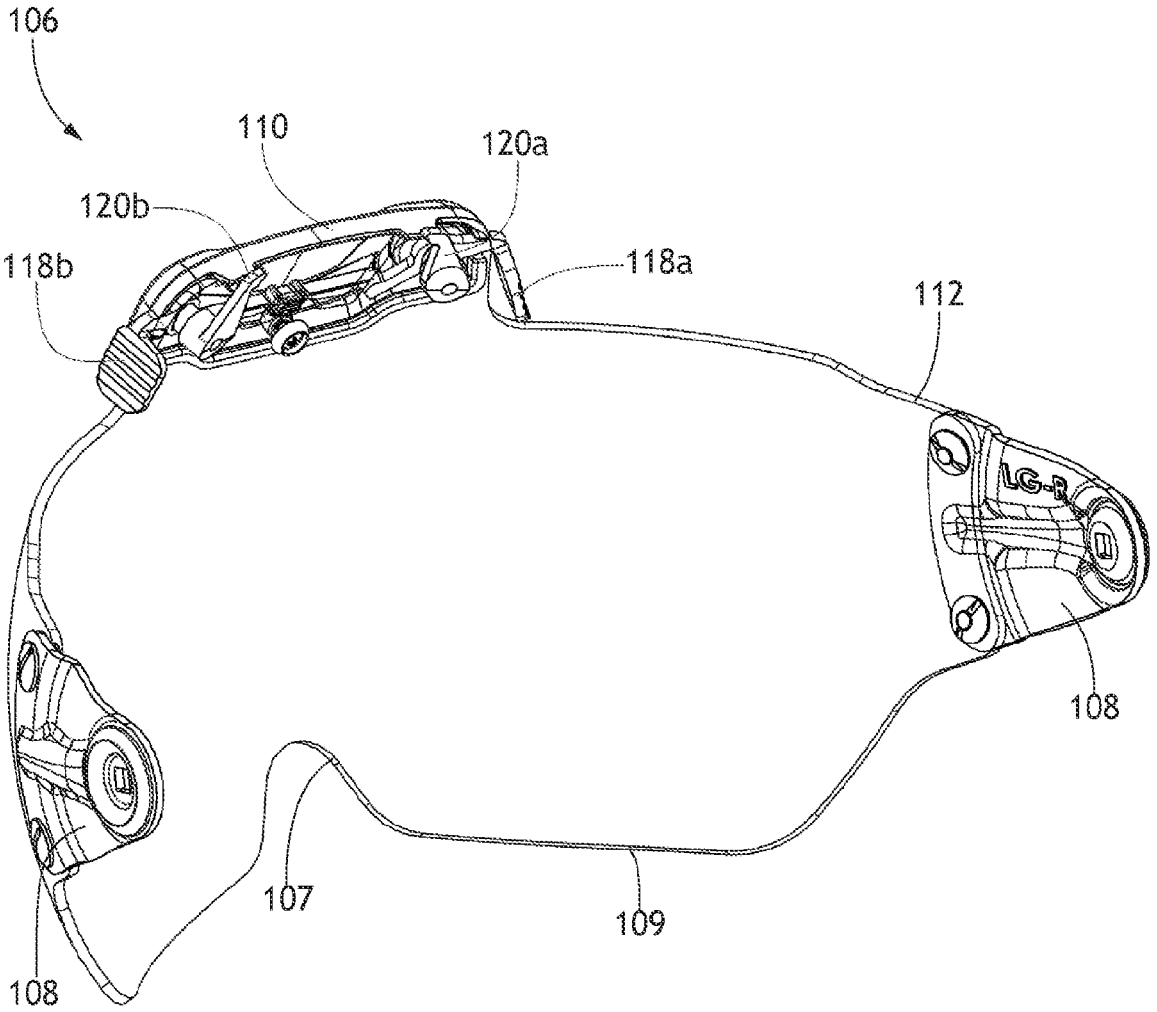
FIG. 6 is a rear perspective view of the visor of FIG. 1.
Figure 7:
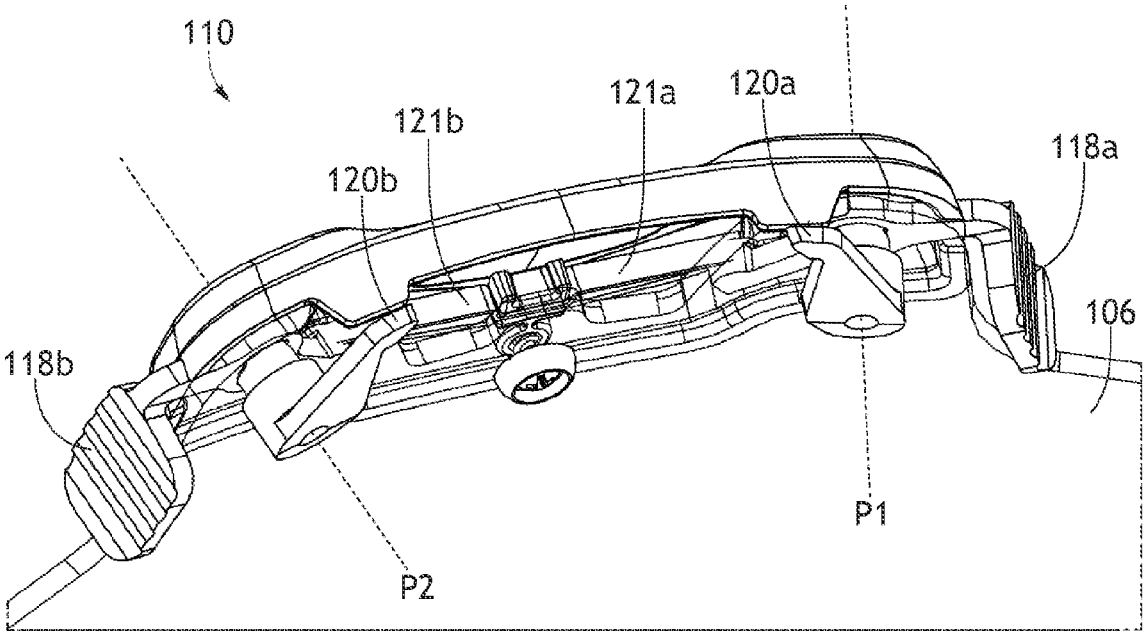
FIG. 7 is a zoomed in view of the latching mechanism of the visor of FIG. 1.

Referring to FIGS. 5-7, the latching mechanism 110 may be disposed along a top edge 112 of visor 106. The latching mechanism 110 may be positioned in a generally central location along the length of visor 106. Latching mechanism 110 may be fixedly or removably coupled to visor 106. For example, latching mechanism 110 may be fixedly coupled to visor 106 via fasteners, screws, magnets, adhesives, heating, or any other coupling mechanism desired. In other embodiments, the latching mechanism 110 may be detachably coupled to the visor 106. The latching mechanism 110 may be configured to releasably lock the visor 106 in a plurality of positions relative to helmet cover 102. The latching mechanism 110 may be configured to engage locking engagements 116*a*, 116*b* and/or the shroud mount 114 to lock the visor 106 in place relative to helmet cover 102. The latching mechanism may include a first user operable arm 118*a* and a second user operable arm 118*b* for manually disengaging the latching mechanism 110 such that the visor 106 may be pivoted relative to the helmet cover 102. The first arm 118*a* may be coupled to a first pawl 120*a* and the second arm 118*b* may be coupled to a second pawl 120*b*. The first arm 118*a* and second arm 118*b* may be configured to rotate the first pawl 120*a* and second pawl 120*b*, respectively, from a first position to a second position.

For example, a user may pinch the first arm 118*a* and second arm 118*b* towards one other causing the first pawl 120*a* and second pawl 120*b* to rotate from a locked position (FIG. 5) to an unlocked position (not shown). In the unlocked position, the distance between first pawl 120*a* and second pawl 120*b* may be greater than the distance between the two pawls 120*a*, 120*b* when in the locked position. In some embodiments, the first arm 118*a* and second arm 118*b* are independently operable. For example, a user may press the first arm 118*a* inwardly toward the second arm 118*b* without causing the second arm 118*b* to rotate, and vice versa. In some embodiments, the first arm 118*a* and second arm 118*b* may be mechanically coupled such that rotation of the first arm 118*a* causes the second arm 118*b* to rotate. For example, a user may press the first arm 118*a* inwardly causing the first arm to rotate in a first direction toward the second arm 118*b* and thereby causing the second arm 118*b* to rotate in a second direction opposite the first direction toward the first arm, and vice versa.

Referring to FIG. 7, first arm 118*a* and first pawl 120*a* may be configured to rotate about axis P1. Second arm 118*b* and second pawl 120*b* may be configured to rotate about axis P2. First arm 118*a* may be mechanically coupled to first pawl 120*a* such that rotation of first pawl 120*a* causes first arm 118*a* to rotate and vice versa. Second arm 118*b* and second pawl 120*b* may be mechanically coupled such that rotation of second pawl 120*b* causes second arm 118*b* to rotate and vice versa. Each of first pawl 120*a* and 120*b* may be biased towards the locked position. The latching mechanism 110 may include a first biasing element 121*a* configured to bias first pawl 120*a* toward the locked position. The first biasing element 121*a* may be coupled to first arm 118*a* such that when a user rotates first arm 118*a* inwards toward second arm 118*b*, the biasing element 121*a* deflects from an initial position (shown in FIG. 7) to a deflected position (not shown). The first biasing element 121*a* may be configured such that, when a user releases first arm 118*a*, the first arm 118*a* is rotated back to the position shown in FIG. 7, causing the first pawl 120*a* to return to the locked position. The locking mechanism may include a second biasing element 121*b* configured to bias second pawl 120*b* toward the locked position. The second biasing element may be coupled to second arm 118*b* such that when a user rotates the second arm 118*b* inwards toward first arm 118*a*, the biasing element 121*b* deflects from an initial position (shown in FIG. 7) to a deflected position (not shown). The second biasing element 121*b* may be configured such that, when a user releases second arm 118*b*, second arm 118*b* is rotated back to the position shown in FIG. 7, causing the second pawl 120*b* to return to the locked position. In some embodiments, the first pawl 120*a* and second pawl 120*b* are independently biased. In some embodiments, the first and second biasing elements 121*a*, 121*b* are made of a resilient material. In other embodiments, the first and second biasing elements are springs.

Figure 9:
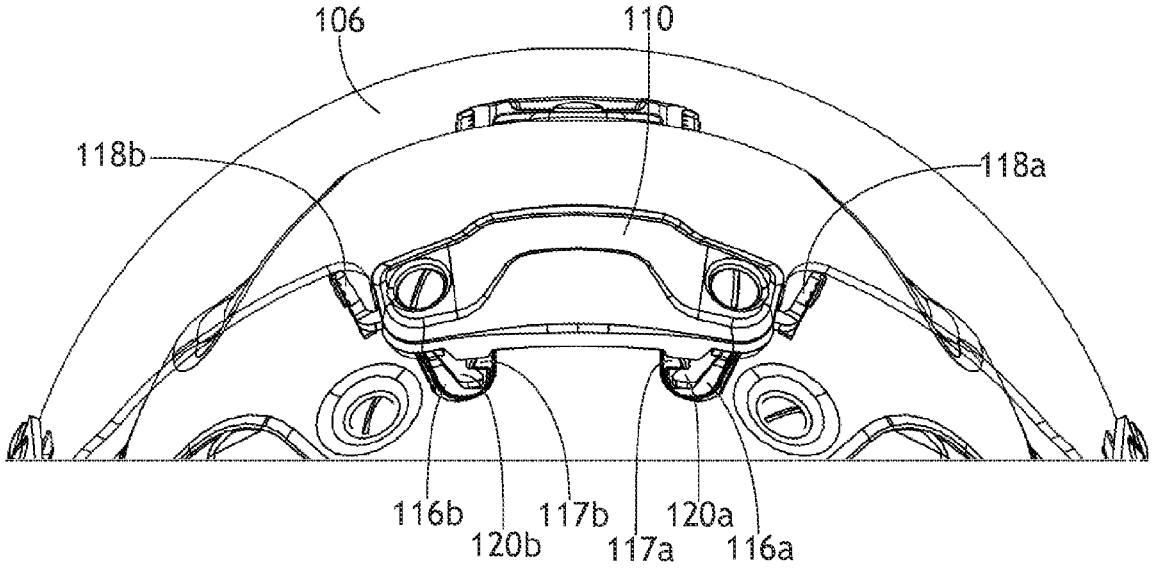
FIG. 9 is a zoomed in view of the latching mechanism of FIG. 7 engaged with the first pair of locking engagements.

Referring to FIGS. 4 and 9, the visor 106 is shown in a stowage position. The visor 106 may be locked in place in the stowage position by the engagement of the latching mechanism 110 with the locking engagements 116*a*, 116*b*. In the stowage position, one or more of the first pawl 120*a* and second pawl 120*b* of the latching mechanism 110 may be engaged with a corresponding ratchet 117*a*, 117*b* of locking engagements 116*a*, 116*b*. In some embodiments, only one of the first pawl 120*a* or second pawl 120*b* needs to be engaged with a corresponding ratchet 117*a*, 117*b* for the visor 106 to be locked in the stowage position. While one or more of the first and second pawls 120*a*, 120*b* are engaged with corresponding ratchets 117*a*, 117*b*, the visor 106 may be prevented from being moved from the stowage position. A user may press first arm 118*a* and second arm 118*b* inwards such that the first arm 118*a* and second arm 118*b* rotate inwardly causing the corresponding pawls 120*a*, 120*b* to rotated outwardly allowing the visor 106 to be moved from the stowage position towards a usage position. Put another way, a user may press the first arm 118*a* and second arm 118*b* such that the pawls 120*a*, 120*b* disengage from the corresponding ratchets 117*a*, 117*b* thereby allowing the visor 106 to be manually rotated from the stowage position and towards a usage position.

Figure 10:
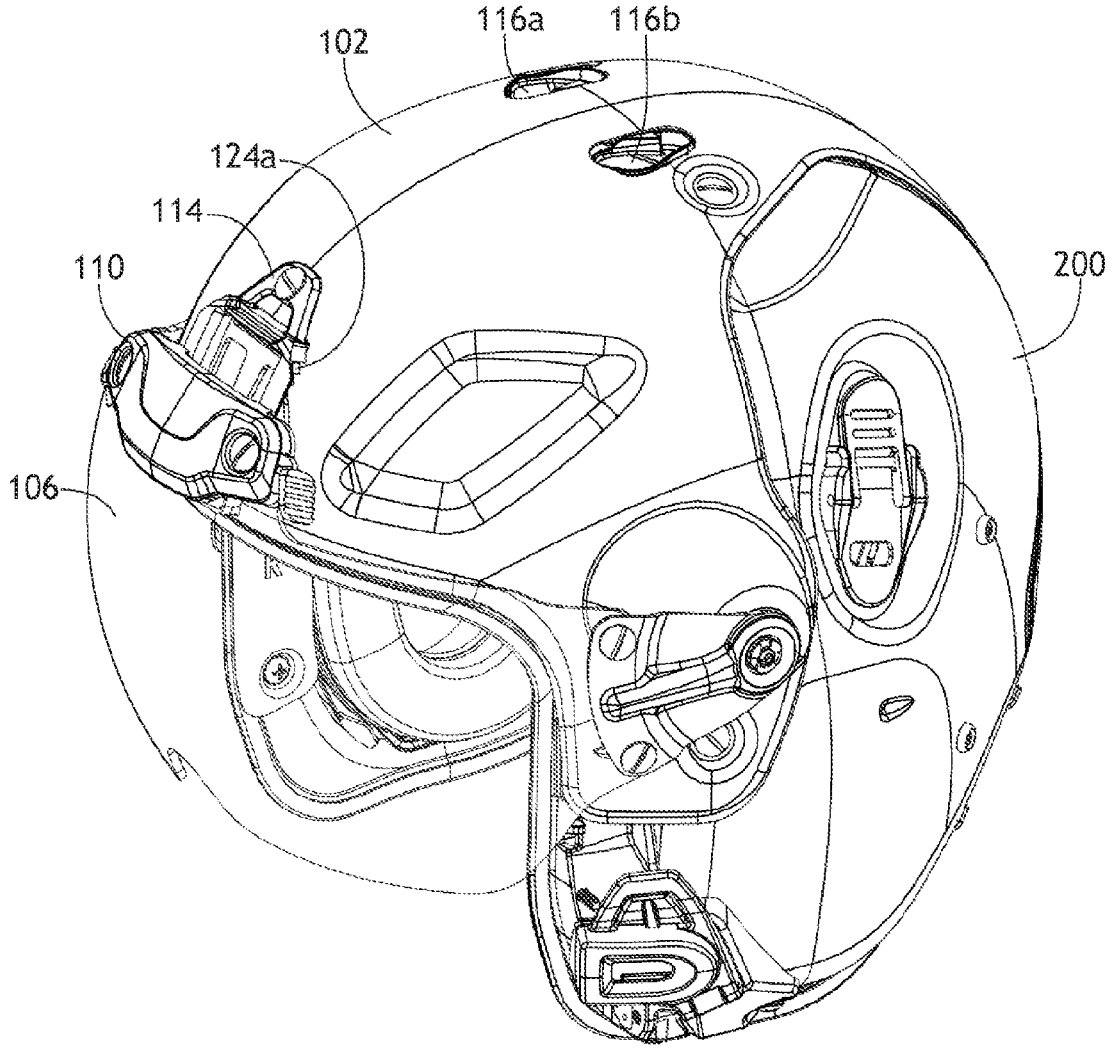
FIG. 10 is a perspective view of the helmet and helmet mounted visor assembly of FIG. 3 shown in a usage position.
Figure 12:
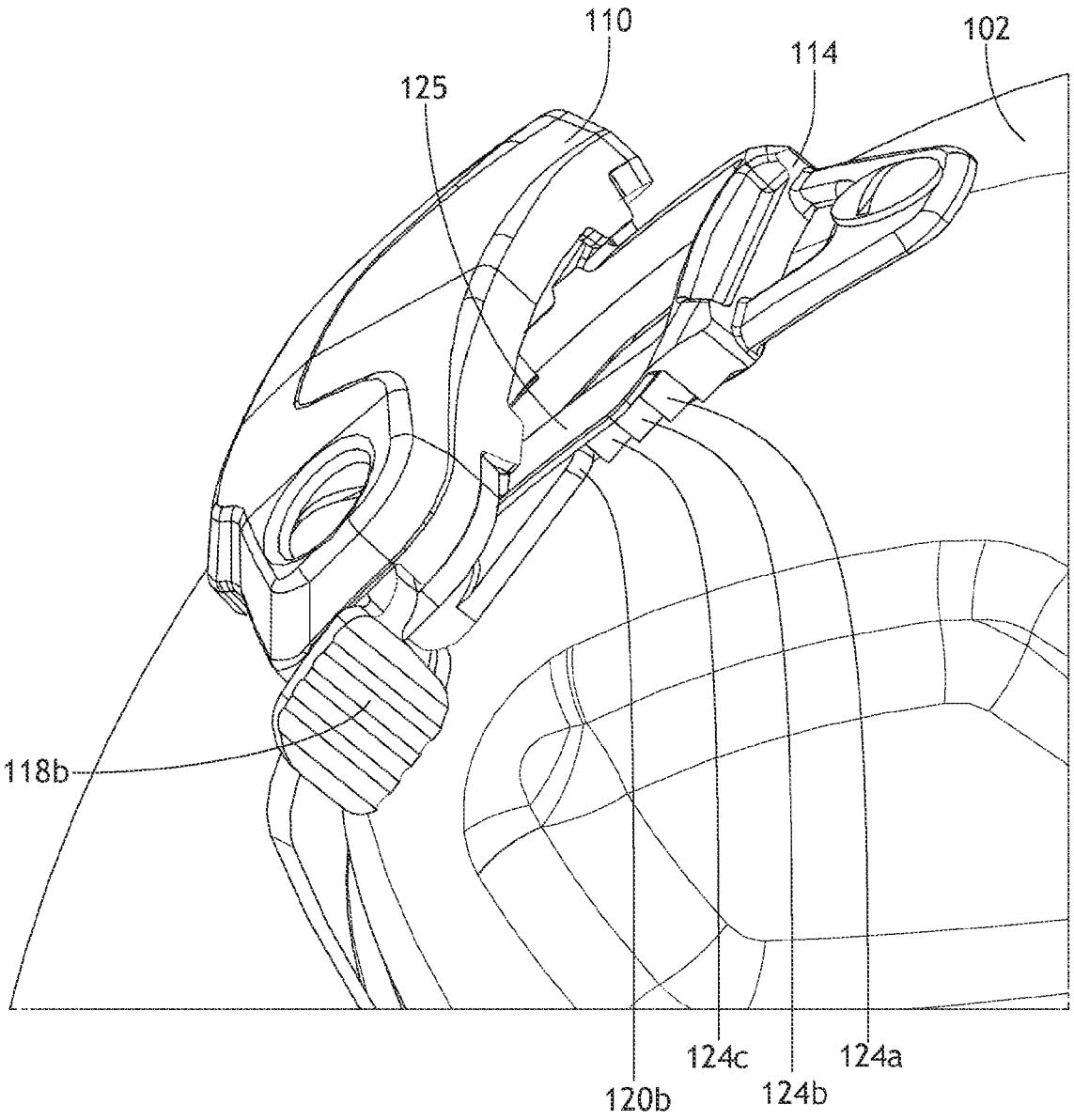
FIG. 12 is a zoomed in view of the latching mechanism of FIG. 7 engaged with the second pair of locking engagements.

Referring to FIGS. 10 and 12, in the usage position, one or more of pawls 120*a* and 120*b* may be engaged with a corresponding ratchet 124*a*-124*c* of shroud mount 114. Engagement of pawls 120*a* and 120*b* with a corresponding ratchet 124*a*-124*c* may cause the visor 106 to be prevented from moving upwards towards the stowage position. In some embodiments, a user may adjust the position of visor 106 by operating first and second arms 118*a*, 118*b* to move the pawls 120*a*, 120*b* to an unlocked position thereby allowing the user to adjust visor 106 to a desired position. For example, if pawls 120*a* and 120*b* are currently engaged with ratchet 124*c*, as well as the corresponding ratchet on the left side of shroud mount 114, a user may press arms 118*a*, 118*b* inwards towards each other and manually pivot the visor 106 about axis A towards the stowage position. Once the user has pivoted the visor 106 to the desired location, the user may then release arms 118*a*, and 118*b* such that the corresponding biasing elements 121*a*, 121*b* cause pawls 120*a*, 120*b* to rotate back to the locked position to engage with ratchets on the shroud mount 114 corresponding to the desired position (e.g., ratchet 124*b*, ratchet 124*a*). Ratchets

124*a*-124*c* may be configured to prevent movement along the path from ratchets 124*c* to 124*a* while one or more of pawls 120*a* and 120*b* are engaged with one of the pairs of ratchets 124*a*-124*c*.

Figure 13:
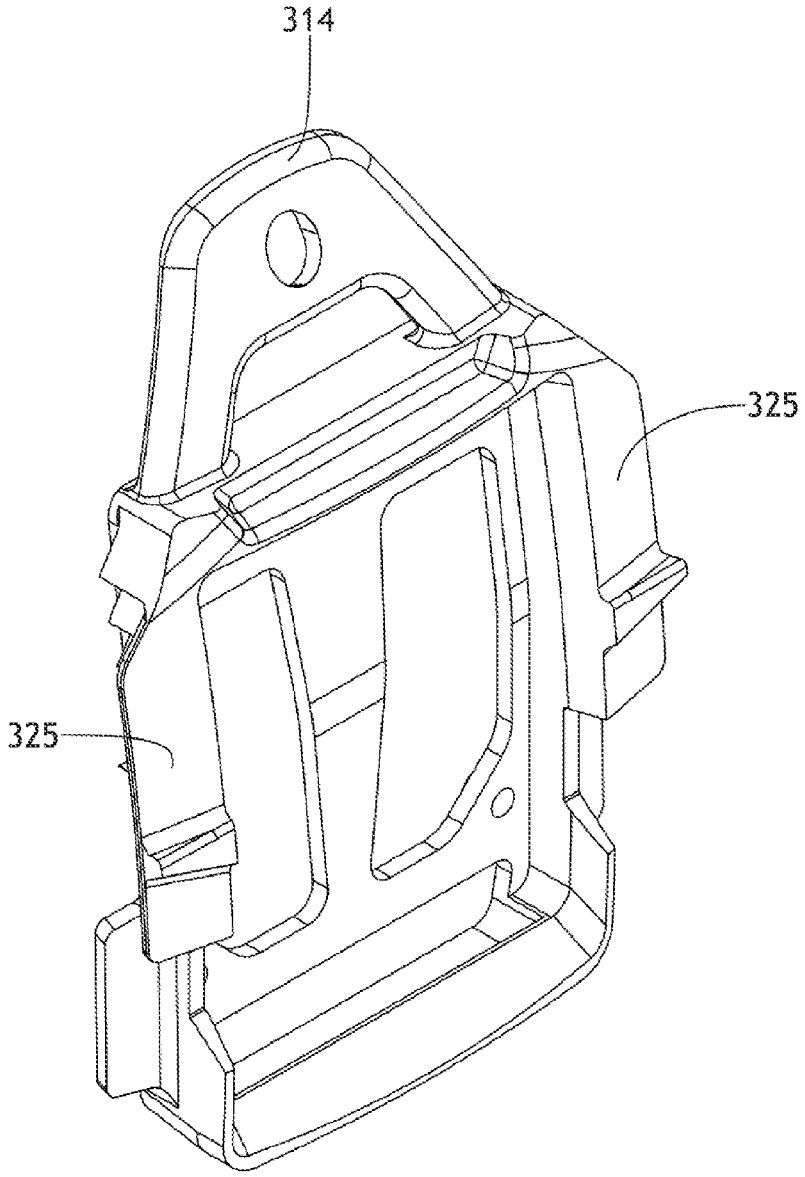
FIG. 13 is a front perspective view of a shroud mount in accordance with another exemplary embodiment of the present disclosure.
Figure 14:
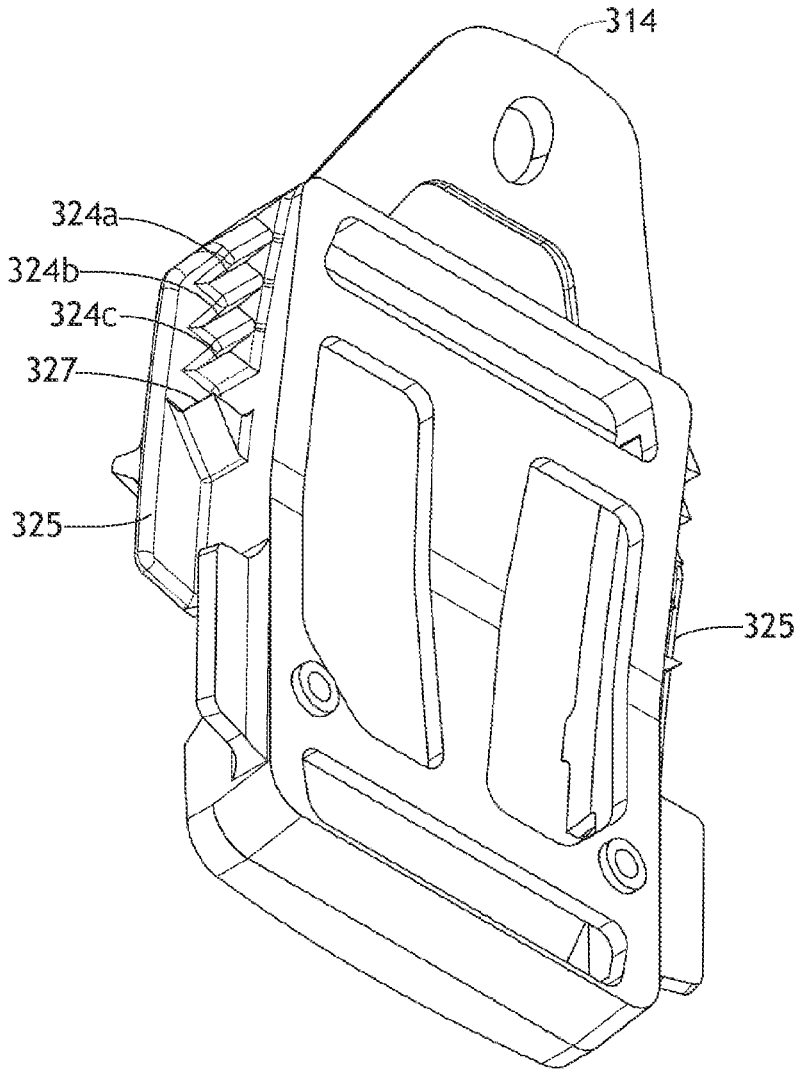
FIG. 14 is a rear perspective view of the shroud mount of FIG. 13.
Figure 15:
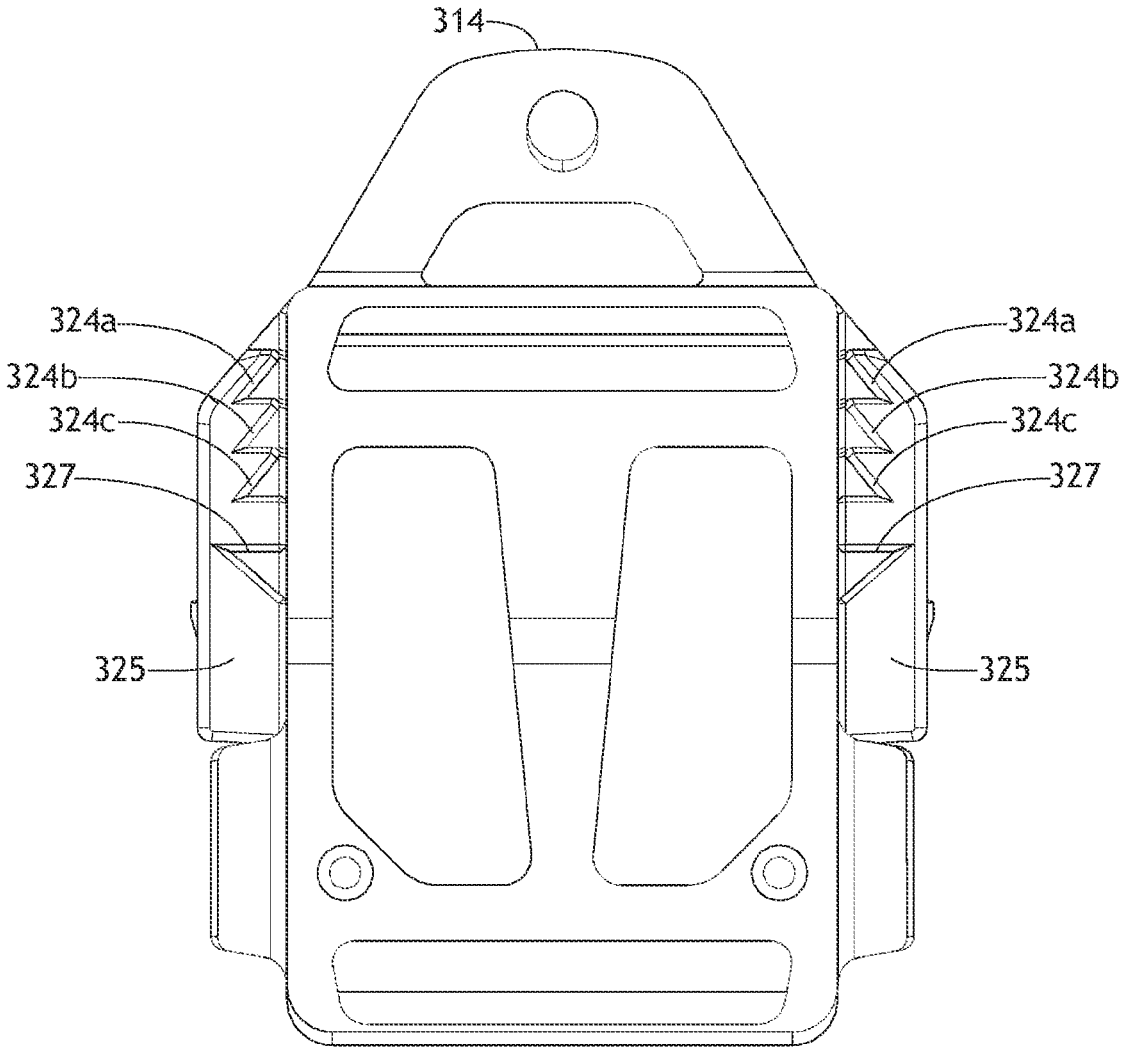
FIG. 15 is a rear elevational view of the shroud mount of FIG. 13.

Referring to FIGS. 13-15 there is shown a shroud mount, generally designated 314, in accordance with another exemplary embodiment of the present disclosure. The shroud mount 314 may be generally the same as shroud mount 114 except that it may include one or more stops (e.g., stops 327) positioned proximate a corresponding ratchet. The stops 327 may be configured to prevent the visor 106 from being rotated in a clockwise direction by a predetermined amount. For example, the stops 327 may be positioned below the last ratchet 324*c* on either side of the shroud mount 314. In this manner, the stops 327 may prevent the corresponding pawls 120*a*, 120*b* of the latching mechanism 110 of the visor 106 from being rotated in a clockwise direction beyond the ratchet 324*c* and/or stop 327. By providing stops 327, the visor 106 may be prevented from unintentionally disengaging from the shroud mount 114 or becoming unintentionally stuck in an unintended position relative to the shroud mount 314.

The shroud mount 314 may also be different from shroud mount 114 in that the flange 325 is longer than flange 125. For example, the flange 325 may extend further along the outer surface of the shroud mount 314 in a direction extending from the top of the shroud mount 314 to the bottom of the shroud mount 314, when compared to flange 125 of shroud mount 114. Put another way, the flange 325 extends further along the direction that the visor 106 rotates about the helmet cover 102 than flange 125. In this manner, the flange 325 may further reduce the risk of the visor 106 from disengaging from shroud mount 314 due to movement of the visor 106 in a direction away from the outer surface of the helmet cover 102. It will be understood that ratchets 324*a*-324*c* are generally the same as ratchets 124*a*-124*c*. Furthermore, it will be understood that the remaining features, structure, and/or characteristics of shroud mount 114, as described in relation to the shroud mount 114, and as described in relation to any other components of the helmet mounted visor assembly 100, also apply to shroud mount 314. Put another way, shroud mount 314 functions generally the same as shroud mount 114, with the exception of the extended flange 325 and stops 327. Therefore, it will be understood that shroud mount 314 and 114 may be interchanged with one another in helmet mounted visor assembly.

Figure 16:
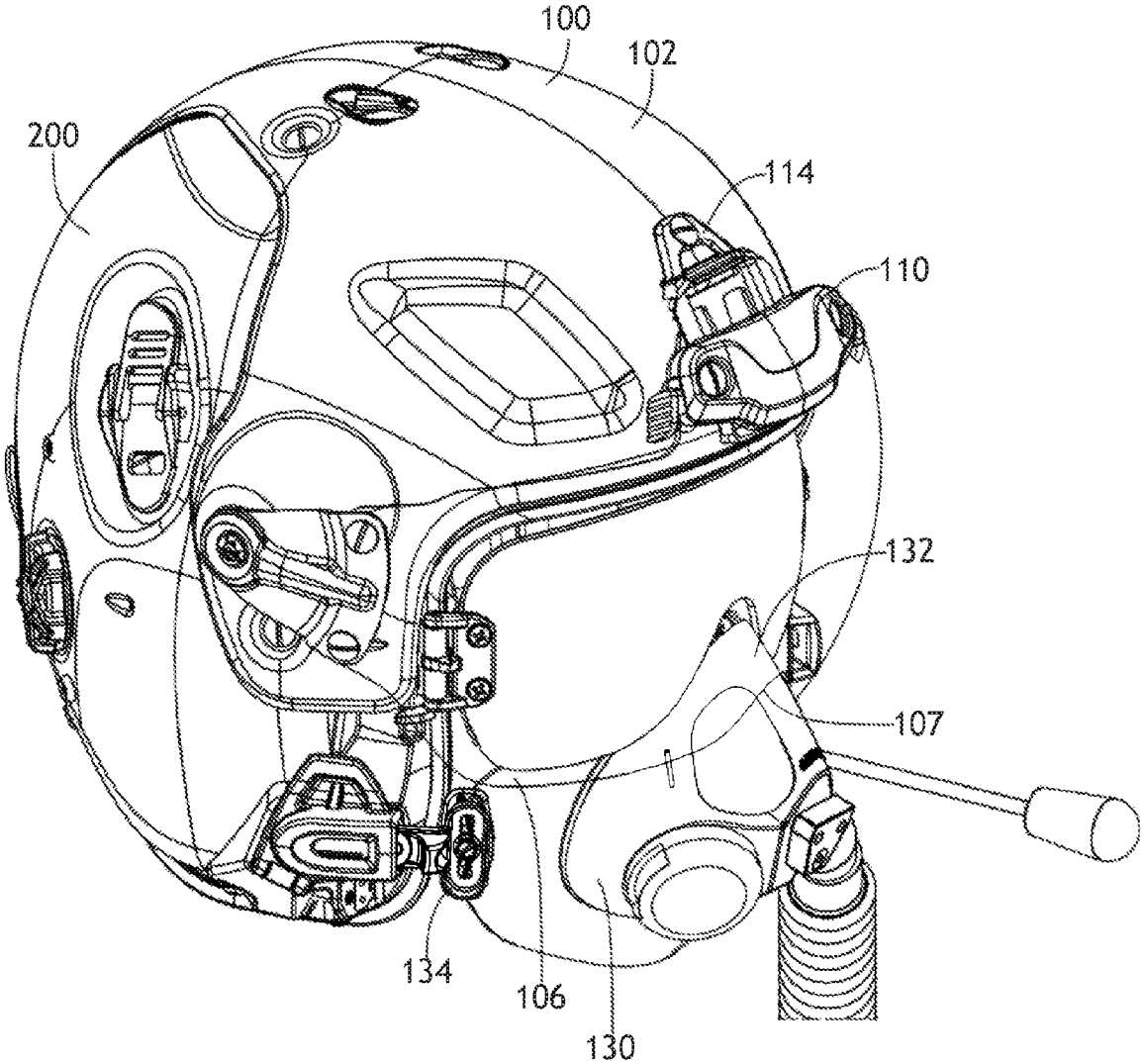
FIG. 16 is a perspective view of the helmet and helmet mounted visor assembly of FIG. 3 shown in the usage position and with additional accessories coupled to the helmet.

Referring to FIGS. 5-6, the visor 106 may include a nose cavity 107 for receiving a nose portion of a mask (e.g., the nose portion of an oxygen mask). The nose cavity 107 may be disposed along a bottom edge 109 of visor 106. The nose cavity 107 may be positioned in a generally central location along the length of visor 106. The visor 106 may extend laterally from a user's eyes and nose, and curve towards the user's temple. Referring to FIG. 16, there is shown the helmet mounted visor assembly 100 in a usage position while an oxygen mask 130 is worn by a user. The oxygen mask 130 may include a nose portion 132 configured to cover a user's nose. The nose cavity 107 may be shaped and sized to receive the nose portion 132 of oxygen mask 130. Oxygen mask 130 may be coupled to helmet 200 by one or more mask mounts 134. Mask mounts 134 may be configured to couple to a bottom edge of helmet 200 near a user's chin. Mask mounts 134 may include straps (not shown) extending from mask mounts 134 to oxygen mask 130 to couple the oxygen mask to helmet 200 such that oxygen mask 130 is held in place relative to a user's face. In some embodiments, one or more of mask mounts 134 is configured to be manually detached from helmet 200 such that a user may remove the oxygen mask 130 if needed.

In some embodiments, there may be a fabric cover (not shown) that is configured to couple to the helmet 200 and/or helmet mounted visor assembly 100. The fabric cover may be separate and distinct from helmet cover 102. In some embodiments, the fabric cover is comprised of one or more generally flexible and/or elastic materials. The fabric cover may be comprised of one or more woven or non-woven fabric materials. In some embodiments, the fabric cover may include a variety of patterns and/or colors, such as, but not limited to, camouflage patterns. In some embodiments, the fabric cover may be sized to cover substantially all of the outer surface 202 of the helmet 200. In some embodiments, the fabric cover is sized to cover the outer surface of the helmet cover 102 and the outer surface 202 of the helmet 200.

It will be appreciated by those skilled in the art that changes could be made to the exemplary embodiments shown and described above without departing from the broad inventive concepts thereof. It is understood, therefore, that this invention is not limited to the exemplary embodiments shown and described, but it is intended to cover modifications within the spirit and scope of the present invention as defined by the claims. For example, specific features of the exemplary embodiments may or may not be part of the claimed invention and various features of the disclosed embodiments may be combined. Unless specifically set forth herein, the terms "a", "an" and "the" are not limited to one element but instead should be read as meaning "at least one".

It is to be understood that at least some of the figures and descriptions of the invention have been simplified to focus on elements that are relevant for a clear understanding of the invention, while eliminating, for purposes of clarity, other elements that those of ordinary skill in the art will appreciate may also comprise a portion of the invention. However, because such elements are well known in the art, and because they do not necessarily facilitate a better understanding of the invention, a description of such elements is not provided herein.

Further, to the extent that the methods of the present invention do not rely on the particular order of steps set forth herein, the particular order of the steps should not be construed as limitation on the claims. Any claims directed to the methods of the present invention should not be limited to the performance of their steps in the order written, and one skilled in the art can readily appreciate that the steps may be varied and still remain within the spirit and scope of the present invention.

What is claimed is:

1. A visor assembly for a helmet, the visor assembly comprising:

a helmet cover configured to couple to a helmet;

a visor pivotably coupled to the helmet cover and configured to selectively pivot between a stowage position and one or more usage positions relative to the helmet cover;

a shroud mount coupled to the helmet cover and configured to couple one or more accessories to the helmet cover, the shroud mount including one or more ratchets configured to engage the latching mechanism when the visor is in a usage position of the one or more usage positions; and a latching mechanism coupled to the visor, the latching mechanism including a first pawl configured to rotate between a locked position and an unlocked position, the latching mechanism further configured to releasably lock the visor in one or more of the stowage positions and the one or more usage positions, wherein the helmet cover includes a pair of locking engagements configured to releasably lock the visor in the stowage position.

2. The visor assembly of claim 1, wherein the shroud mount includes one or more flanges, the one or more ratchets disposed between the one or more flanges and the helmet cover.

3. The visor assembly of claim 1, wherein the shroud mount includes one or more stops positioned proximate the one or more ratchets, the one or more stops configured to prevent rotation of the visor in at least one direction.

4. The visor assembly of claim 1, wherein the latching mechanism includes a second pawl disposed opposite the first pawl, the second pawl configured to rotate between the locked position and the unlocked position.

5. The visor assembly of claim 1, wherein the latching mechanism is fixedly coupled to a top surface of the visor.

6. The visor assembly of claim 1, wherein the latching mechanism includes a first biasing element biasing the first pawl towards the locked position.

7. The visor assembly of claim 1, wherein the visor is configured to selectively pivot relative to the helmet cover between three or more positions.

8. The visor assembly of claim 1, wherein the helmet cover extends from a front portion of the helmet to a rear portion of the helmet and across an area of the helmet corresponding to a user's forehead.

9. A helmet system comprising:

a helmet having an outer surface and an inner surface;

a helmet cover coupled to the outer surface of the helmet;

a visor pivotably coupled to the helmet cover and configured to selectively pivot from a stowage position to one or more usage positions relative to the helmet cover;

a shroud mount coupled to the helmet cover and configured to couple one or more accessories to the helmet cover, the shroud mount including one or more ratchets configured to engage the latching mechanism when the visor is in a usage position of the one or more usage positions; and a latching mechanism coupled to the visor, the latching mechanism including a first pawl configured to rotate between a locked position and an unlocked position, the latching mechanism further configured to releasably lock the visor in one or more of the stowage positions and the one or more usage positions, wherein the helmet cover includes a pair of locking engagements configured to releasably lock the visor in the stowage position.

10. The helmet system of claim 9, wherein the shroud mount includes one or more flanges, the one or more ratchets disposed between the flanges and helmet cover.

11. The helmet system of claim 9, wherein the shroud mount includes one or more stops positioned proximate the one or more ratchets, the one or more stops configured to prevent rotation of the visor in at least one direction.

12. The helmet system of claim 9, wherein the latching mechanism includes a second pawl disposed opposite the first pawl, the second pawl configured to rotate between the locked position and the unlocked position.

13. The helmet system of claim 9, wherein the latching mechanism is fixedly coupled to the visor.

14. The helmet system of claim 9, wherein the latching mechanism includes a first biasing element biasing the first pawl towards the locked position.

15. The helmet system of claim 9, wherein the visor is configured to selectively pivot relative to the helmet cover between three or more positions.

16. The helmet system of claim 9, wherein the helmet cover extends from a front portion of the helmet to a rear portion of the helmet and across an area of the helmet corresponding to a user's forehead.

17. A visor assembly comprising:

a helmet cover configured to couple to an outer surface of a helmet;

a visor having a top surface and a bottom surface, the visor coupled to the helmet cover and configured to pivot between a stowage position and one or more usage positions relative to the helmet cover;

a latching mechanism coupled to the top surface of the visor, the latching mechanism including a first pawl configured to rotate between a locked position and an unlocked position, a second pawl disposed opposite the first pawl, the second pawl configured to rotate between the locked position and the unlocked position, the latching mechanism further configured to releasably lock the visor in one or more of the stowage position and the one or more usage positions;

a shroud mount coupled to the helmet cover, the shroud mount including one or more ratchets configured to engage the latching mechanism when the visor is in a usage position of the one or more usage positions; and a pair of locking engagements coupled to the helmet cover and configured to releasably lock the visor in the stowage position.

18. The visor assembly of claim 17, wherein the shroud mount includes one or more stops positioned proximate the one or more ratchets, the one or more stops configured to prevent rotation of the visor in at least one direction.

* * * * *